United States Patent [19]

Hartzell et al.

[11] 4,085,831

[45] Apr. 25, 1978

[54] ROD GUARD FOR BOTTOM BRAKE ROD

[75] Inventors: Herschell H. Hartzell; Norbert F. Mullaney, both of Milwaukee, Wis.

[73] Assignee: A. O. Smith Corporation, Milwaukee, Wis.

[21] Appl. No.: 786,344

[22] Filed: Apr. 11, 1977

[51] Int. Cl.[2] ..... B61H 13/34

[52] U.S. Cl. ..... 188/210

[58] Field of Search ..... 188/205 R, 207, 210, 188/214, 219.1, 233.3

[56] References Cited

U.S. PATENT DOCUMENTS

| | | | |
|---|---|---|---|
| 1,207,255 | 12/1916 | Williams | 188/210 |
| 1,303,064 | 5/1919 | Horrigan | 188/210 |
| 1,578,301 | 3/1926 | Walker | 188/210 |
| 1,867,000 | 7/1932 | Crone | 188/210 |
| 2,089,584 | 8/1937 | Smith | 188/210 |
| 3,092,213 | 6/1963 | Nelson | 188/210 |

*Primary Examiner*—Duane A. Reger

*Attorney, Agent, or Firm*—Andrus, Sceales, Starke & Sawall

[57] ABSTRACT

A rod guard adapted to be attached to a brake beam member to prevent a disconnected or broken brake rod from falling from a railway car. The guard consists of a looped hanger and a clamp having the general configuration of the brake beam member to which the rod guard is to be applied. A lower loop of the hanger encircles the brake rod. An upper loop of the hanger extends through a slot in the clamp exposed forwardly of the front surfaces of the brake beam member and is secured to the clamp by a reversely bent central tab forced over the upper horizontally extending end of the hanger such as by a hammer. The clamp is secured to the brake beam by a pair of horizontally spaced end tabs between which the upper end of the hanger is received and held by the end tabs against spreading. The end tabs are forced over the brake beam member by a hammer or the like in a direction opposite to the center tab to secure the guard to the brake beam.

5 Claims, 6 Drawing Figures

ROD GUARD FOR BOTTOM BRAKE ROD

BACKGROUND OF THE INVENTION

The rod guard of the invention consists of a looped hanger and clamp which are constructed in a manner so that they may be readily assembled with each other and secured together and to a brake beam member such as by a hammer or the like. The rod guard is thus easily assembled and disabled from the brake beam member. The clamp may be made of different configurations depending upon the brake beam member to which it is to be applied without changing the basic construction for securing the looped hanger and clamp together and to the brake beam member. Likewise the lower loop of the looped hanger through which the brake rod extends and which the guard is employed to prevent the rod from falling to the bed of a railroad track if broken or disconnected can take different configurations depending upon the configuration of the brake rod and the other parts of the braking system which may be involved without any change in the basic construction for securing the rod guard in place.

SUMMARY OF THE INVENTION

The invention is directed to a bottom rod guard for catching broken or disconnected brake rods of railway cars. The rod guard consists of two parts, namely a looped hanger and a clamp.

The clamp has the general configuration of the brake beam member to which it is to be attached and when assembled extends in engagement with the back surfaces of the beam and over the upper and lower extent of the brake beam member.

The upper portion of the clamp is provided with tabs at the outer end of a length to be turned over the brake beam member to hold the rod guard in place and a central tab to receive and secure the looped hanger of the clamp and brake beam member. The lower portion of the clamp projects forwardly from the brake beam member to expose a surface in which is located a slot. The looped hanger in the bottom portion is provided with a generally large loop configuration through which the brake rod and appurtenant parts extend. The lower loop portion of the looped hanger terminates upwardly in a pair of horizontally spaced elongated arms which are turned toward each other at the upper end to extend in a horizontal direction and provide a split bar on the hanger on the upper end. Upon assembly the arms of the looped hanger extend upwardly through the slot in the clamp and over the front surfaces of the brake beam member to which the rod guard is to be attached and at the upper end the arms extend between the end tabs to prevent spreading of the arms and then over a central tab on the clamp which is reverse bent opposite to the end tabs of the clamp to secure the looped hanger to the clamp. The lower loop of the hanger is offset from the arms and the bottom surface of the clamp which acts as a stop to govern the upper movement of the looped hanger.

DESCRIPTION OF THE EMBODIMENTS OF THE INVENTION

Figure 2:
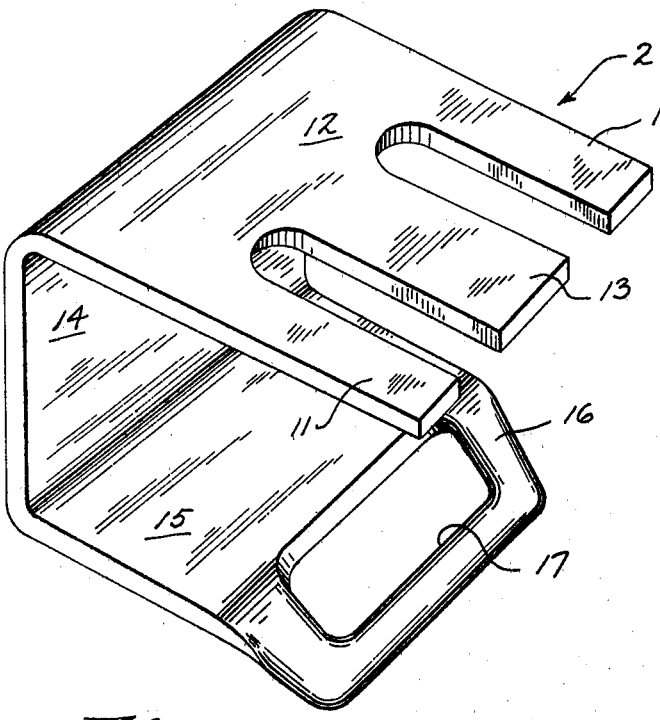
FIG. 2 is a perspective view of the clamp.
Figure 1:
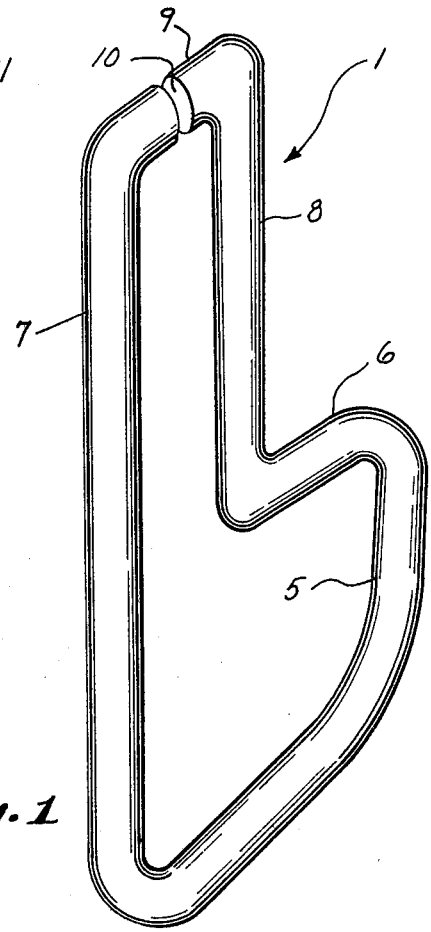
FIG. 1 is a perspective view of the looped hanger.
Figure 3:
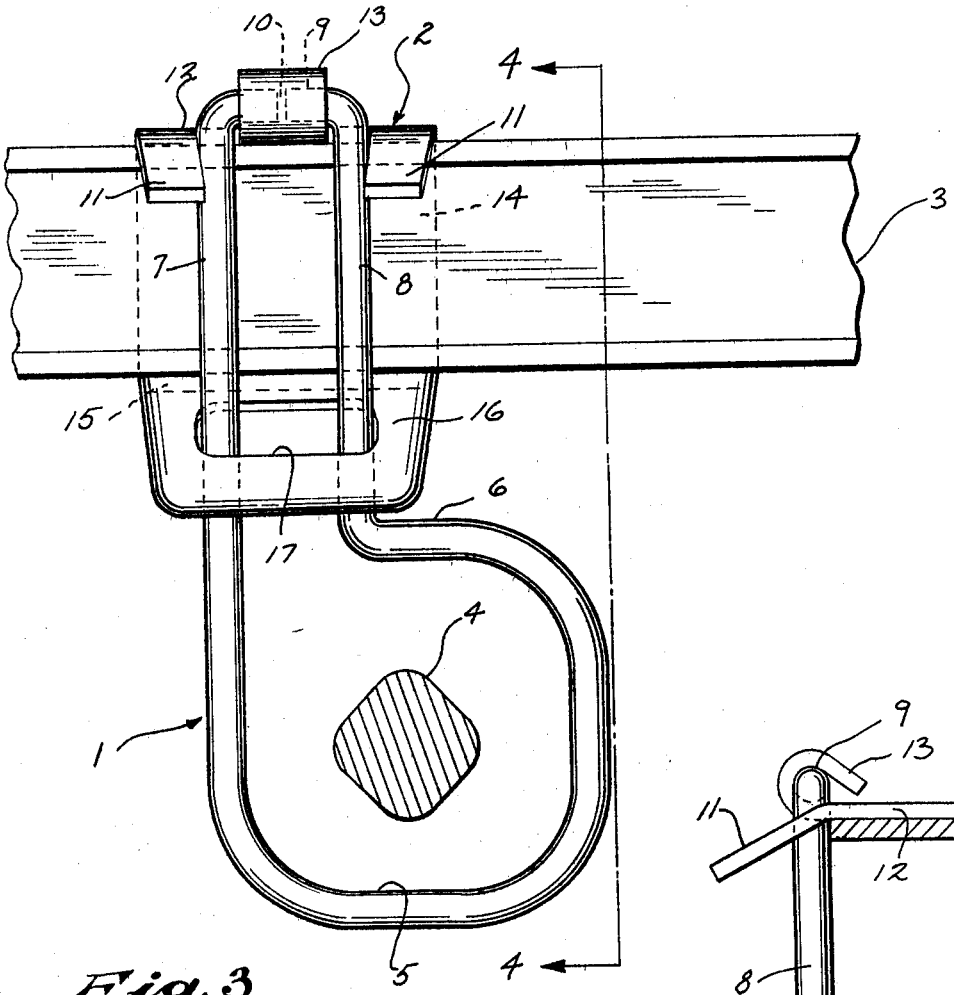
FIG. 3 is a front elevational view of the rod guard as applied to a brake beam member with the brake rod in section.
Figure 4:
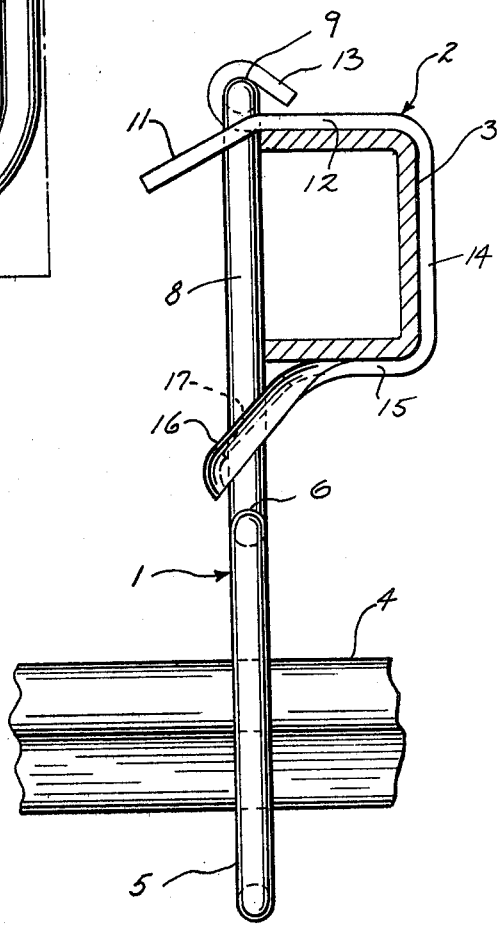
FIG. 4 is a view taken on line 4—4 of FIG. 3 with the brake beam member in section.

Referring to the drawings there is shown in FIGS. 1 and 2 respectively the looped hanger 1 and the clamp 2 as they appear before assembly together and with the brake beam member 3 and the brake rod 4 as shown in FIGS. 3 and 4.

Looped hanger 1 has a generally large loop 5 in the lower portion to receive brake rod 4 and appurtenances thereof. Loop 5 is offset to the right, as shown in the drawings, so that it provides a stop 6 when assembed with clamp 2 to limit the upper movement of looped hanger 1.

Lower loop 5 of looped hanger 1 terminates upwardly in a pair of horizontally spaced arms 7 and 8 which are turned inwardly at the upper end to form an unconnected or split horizontal bar 9 at the upper end in that there is provided a separation 10 generally centrally of bar 9 which eliminates the expense of welding the looped hanger and thus only requires a forming operation.

Clamp 2 before assembly with looped hanger 1 and brake beam member 3 is formed to the general configuration of the brake beam member to which it is to be applied. In the illustration in FIG. 2, clamp 2 is of a general channel shape for application to the channel shaped brake beam member 3 illustrated in FIGS. 3 and 4.

As shown in FIG. 2 the upper portion of clamp 2 has the horizontally spaced end tabs 11 which project forwardly from the upper flange 12 of clamp 2 and a centrally located tab 13 which likewise extends forwardly from the upper flange 12 of clamp 2. The back of clamp 2 extends vertically and the lower portion of clamp 2 has a flange 15 of the configuration of brake beam member 3 and then tapers downwardly as at 16, and tapered surface 16 is of a length to terminate slightly forwardly of the bottom flanged surface 15 of brake beam member 3. The tapered surface 16 of clamp 2 has a slot or opening 17 therethrough.

In assembling looped hanger 1 and clamp 2 together and securing these members to brake beam member 3 as shown in FIGS. 3 and 4, clamp 2 is first lodged over brake beam member 3 so that back 14 and flanges 12 and 15 of clamp 2 extend over and in engagement with the brake beam member 3. This locates the upper flange 12 over the top surface of brake beam member 3 and the lower flange 15 in engagement with the bottom surface of brake beam member 3 and the back 14 of the clamp 2 in engagement with the rear surface of beam 3. The tapered surface 16 carrying the slot 17 is then lodged slightly forwardly of the front surface of brake beam member 3.

The arms 7 and 8 of looped hanger 1 are then slid upwardly through slot 17 in engagement with the front surface of beam member 3 and rocked forwardly at the upper end so that the split bar 9 will slip over center tab 13. The hanger 1 is then rocked rearwardly to engage the base of clamp 1 between the end tabs 11. Thereafter center tab 13 is reverse bent rearwardly over bar 9 by a hammer or the like to secure hanger loop 1 to clamp 2.

In the final assembly end tabs 11 are forced down over the forward surface of brake beam member 3 by a hammer or the like to secure clamp 1 to brake beam member 3. The arms 7 and 8 of looped hanger 1 are lodged between end tabs 11 so that arms 7 and 8 are unable to be spread apart despite the separation 10 in bar 9.

The rod guard is readily disassembled. End tabs 11 are forced upwardly by hitting the tabs with a hammer or the like and the center tab 13 can be readily opened by the rear end of a hammer or like tool and then forced to a forward position to unlatch looped hanger 1. Hanger 1 is then slipped from clamp 1 downwardly through slot 17 and clamp 1 can then be removed manually from brake beam member 3.

Figure 5:
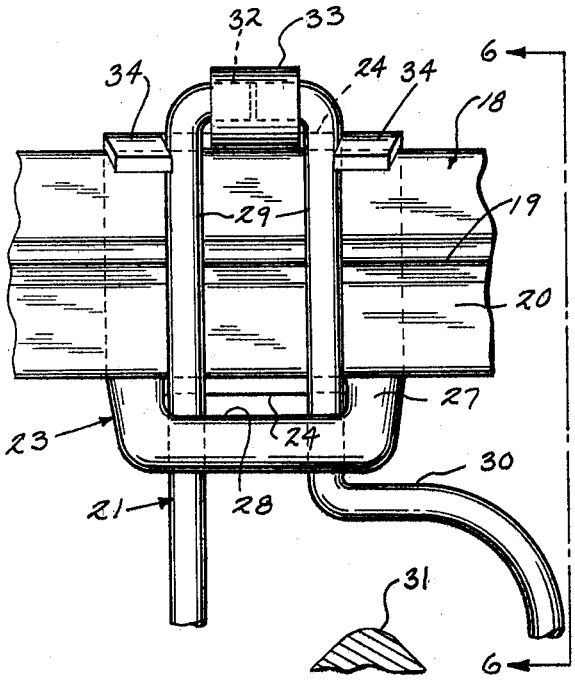
FIG. 5 is a front elevational view with the parts in section and illustrating the shape of the clamp with a differently shaped brake beam member.
Figure 6:
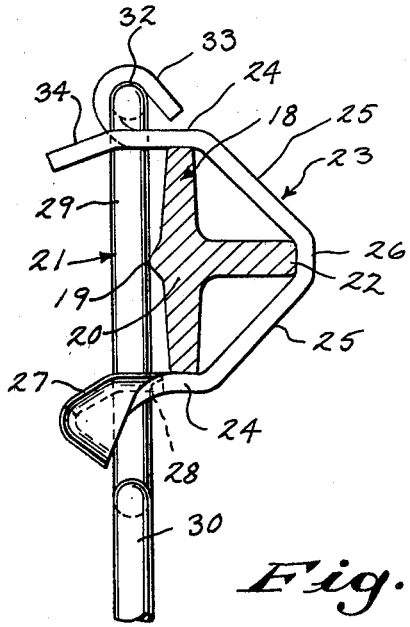
FIG. 6 is a view taken on line 6—6 of FIG. 5 with the brake beam member in section.

FIGS. 5 and 6 show another embodiment of the invention to illustrate the construction of the looped hanger and clamp when applied to a brake beam member of a different shape than a channel configuration.

In FIGS. 5 and 6 there is illustrated a T-shaped brake beam member 18 and in this case a forward projection 19 of the body 20 of the member 18 is in engagement with the looped hanger 21. However, the parts could be reversed so that end surface of the leg 22 of the member 18 is in engagement with the looped hanger 21.

The clamp 23 which is assembled around T-shaped beam member 18 has the generally flat surfaces 24 in engagement with the respective ends of the body 20 of member 18. Each flat surface 24 terminates in the tapered surfaces 25 which taper toward each other and then terminate in a flat surface 26 which is disposed in engagement with the end surface of leg 22 of T-shaped beam member 18.

As with the case with the first embodiment, the lower portion of clamp 23 is provided at the forward end with the downwardly tapered surface 27 extending from the bottom flat surface 24 and projects slightly forwardly of T-shaped beam member 18. Surface 24 has a slot or opening 28 through which arms 29 of the looped hanger 21 extend. The lower portion of looped hanger 21 carries the generally large loop 30 through which brake rod 31 extends as in the first embodiment and engages the tapered surface 27 to limit upward movement of looped hanger 21.

The upper end of looped hanger 21 is of the same construction as described with respect to the first embodiment. The looped hanger 21 has the split or disconnected bar 32 provided at the upper end of the arms 29 which upon assembly is forced over central tab 33 on clamp 23 and the latter is reversely bent over bar 32 to secure the hanger loop to clamp 23. This locates the arms 29 between the end tabs 34 which extend forwardly of clamp 23 and are in turn forced forwardly over the T-shaped brake beam member 18 to secure the rod guard to the beam.

The rod guard illustrated and described with respect to FIGS. 5 and 6 is assembled and disassembled in the same manner as the rod guard of the first embodiment.

The rod guard of the invention is of simple construction and is easily assembled and disassembled on a brake beam member by the use of a manually operated tool such as a hammer.

Various modes of carrying out the invention are contemplated as being within the scope of the following claims particularly pointing out and distinctly claiming the subject matter which is regarded as the invention.

We claim:

1. A rod guard adapted to be attached to a brake beam member to prevent a loose, disconnected bottom brake rod from falling from a railway car, which comprises a looped hanger formed with a loop at the lower end portion to receive the brake rod assembly and terminating in a pair of horizontally space upwardly extending arms in turn terminating in an inwardly turned horizontal member at the upper end, a clamp having a configuration to be assembled over and encircle the brake beam member to which it is to be secured, with a lower portion disposed to project forwardly of the beam with which it is assembled and having an opening therein, a center tab extending from the upper surface of the clamp and disposed to receive the inwardly turned member of the arms of the hooped hanger and to be reversely bent over the inwardly turned member to secure the looped hanger to the clamp, and end tabs secured to the clamp at either side of the center tab and disposed to be bent over the brake beam member to secure the clamp and the assembled rod guard to the brake beam member.

2. The rod guard of claim 1 in which the lower loop of the looped hanger is generally large compared to the arms of the hanger and is offset from the upwardly extending arms to thereby engage the bottom surface of the clamp and limit upward movement of the looped hanger.

3. The rod guard of claim 1 in which the body of the rod guard is of a general channel configuration to securely overlie a brake beam member of channel shape.

4. The rod guard of claim 1 in which the upper and lower end portions at the open end of the clamp are flat to be disposed to engage the ends of the body of a T-shaped brake beam member, and remainder of the body tapers downwardly and terminates in a flat surface disposed to engage the end surface of the leg of the T-shaped beam member.

5. The rod guard of claim 1 in which the inturned member of the arms at the upper end of the looped hanger are separated to eliminate welding of the hanger, and the arms in final assembled position are disposed between the end tabs of the clamp to prevent spreading apart of the looped hanger at the upper end.

* * * * *